US007926160B2

(12) United States Patent
Zifferer et al.

(10) Patent No.: US 7,926,160 B2
(45) Date of Patent: Apr. 19, 2011

(54) METHOD OF FORMING A LINED TUBULAR MEMBER

(75) Inventors: L. Robert Zifferer, Waco, TX (US); Edward A. Reed, Waco, TX (US)

(73) Assignee: Packless Industries, Waco, TX (US)

( * ) Notice: Subject to any disclaimer, the term of this patent is extended or adjusted under 35 U.S.C. 154(b) by 475 days.

(21) Appl. No.: 11/194,917

(22) Filed: Aug. 1, 2005

(65) Prior Publication Data

US 2006/0021210 A1 Feb. 2, 2006

Related U.S. Application Data

(63) Continuation of application No. 10/246,777, filed on Sep. 18, 2002, now Pat. No. 6,923,035.

(51) Int. Cl.
*B21D 15/03* (2006.01)
*B23P 17/00* (2006.01)

(52) U.S. Cl. ..... 29/421.1; 29/507; 72/58; 72/59; 72/370.19; 72/370.2

(58) Field of Classification Search ..... 29/507, 29/421.1; 72/56, 58, 59, 370.19, 370.2; 138/173, 138/112, 98; 156/287; 264/36.17; 405/184.2
See application file for complete search history.

(56) References Cited

U.S. PATENT DOCUMENTS

| | | | | |
|---|---|---|---|---|
| 629,245 | A | 7/1899 | Frank | |
| 1,777,728 | A | 10/1930 | Kumpf | |
| RE18,272 | E | 12/1931 | Frahm et al. | |
| 1,951,063 | A | 3/1934 | Reimann et al. | |
| 2,110,965 | A | 3/1938 | Singer | |
| 2,205,893 | A | 6/1940 | Unger | |
| 2,207,245 | A | 7/1940 | Dvorak | |
| 2,258,564 | A | 10/1941 | Armstrong et al. | |
| 2,342,117 | A | 2/1944 | Brown, Jr. et al. | |
| 2,365,688 | A | 12/1944 | Dewey | |
| 2,378,729 | A | 6/1945 | Schmidt | |
| 2,499,901 | A | 3/1950 | Brown, Jr. | |
| 2,797,554 | A | 7/1957 | Donovan | |
| 2,982,360 | A | 5/1961 | Morton et al. | |
| 3,028,915 | A | 4/1962 | Jennings | |
| 3,191,680 | A * | 6/1965 | Vincent | 166/387 |

(Continued)

FOREIGN PATENT DOCUMENTS

JP 58159974 9/1983

(Continued)

OTHER PUBLICATIONS

Co-pending U.S. Appl. No. 11/194,915 entitled "Method and Apparatus for Forming a Lined Conduit" to Zifferer et al. filed Aug. 1, 2005; available in private Pair.

(Continued)

*Primary Examiner* — Jermie E Cozart
(74) *Attorney, Agent, or Firm* — Meyertons, Hood, Kivlin, Kowert & Goetzel, P.C.; Eric B. Meyertons

(57) ABSTRACT

A corrugated conduit and method of expanding to form a lined tubular member are described. In some embodiments, a corrugated conduit may be expandable. The corrugated conduit may be inserted into a tubular member and hydraulically or otherwise expanded against walls of the tubular member to strengthen and/or seal the tubular member when the corrugated conduit is expanded in the tubular member. In certain embodiments, the tubular member is a drill stem.

16 Claims, 8 Drawing Sheets

U.S. PATENT DOCUMENTS

| | | | | |
|---|---|---|---|---|
| 3,735,478 | A | 5/1973 | Porter et al. | |
| 3,946,584 | A * | 3/1976 | Yamasaki et al. | 72/60 |
| 4,162,702 | A | 7/1979 | Andersson | |
| 4,377,083 | A | 3/1983 | Shepherd et al. | |
| 4,383,429 | A | 5/1983 | Ceccacci | |
| 4,514,997 | A | 5/1985 | Zifferer | |
| 4,688,319 | A | 8/1987 | Gross et al. | |
| 4,865,127 | A | 9/1989 | Koster | |
| 5,016,806 | A | 5/1991 | Yapp et al. | |
| 5,251,693 | A | 10/1993 | Zifferer | |
| 5,311,661 | A | 5/1994 | Zifferer | |
| 5,390,742 | A | 2/1995 | Dines et al. | |
| 5,419,171 | A * | 5/1995 | Bumgarner | 72/62 |
| 5,810,053 | A * | 9/1998 | Mandich | 138/98 |
| 6,073,692 | A | 6/2000 | Wood et al. | |
| 6,129,999 | A | 10/2000 | Ueda et al. | |
| 6,354,373 | B1 | 3/2002 | Vercaemer et al. | |
| 6,523,574 | B1 * | 2/2003 | Taylor | 138/98 |
| 6,644,356 | B1 * | 11/2003 | Connor et al. | 138/98 |
| 6,722,451 | B2 | 4/2004 | Saugier | |
| 6,749,026 | B2 | 6/2004 | Smith et al. | |
| 6,799,632 | B2 * | 10/2004 | Hall et al. | 166/207 |
| 6,923,035 | B2 | 8/2005 | Zifferer et al. | |
| 7,694,402 | B2 | 4/2010 | Zifferer et al. | |
| 2002/0117226 | A1 * | 8/2002 | Malcarne, Jr. | 138/121 |
| 2010/0229996 | A1 | 9/2010 | Zifferer et al. | |

FOREIGN PATENT DOCUMENTS

| | | | |
|---|---|---|---|
| JP | 58159974 | A * | 9/1983 |

OTHER PUBLICATIONS

US Patent and Trademark Office "Office Communication" for U.S. Appl. No. 11/194,915, mailed Aug. 8, 2008.

International Preliminary Examination Report for International Application No. PCT/US2004/022113; mailed Jan. 16, 2007; 5 pages.

PCT International Search Report for International Application No. No. PCT/US2004/022113; mailed Sep. 27, 2005; 1 page.

PCT Written Opinion for International Application No. No. PCT/US200/022113; mailed Sep. 27, 2007; 4 pages.

PCT "International Search Report and Written Opinon" for International Application No. PCT/US06/29983, mailed Jul. 7, 2008.

PCT "International Preliminary Report on Patentablity" for International Application No. PCT/US06/29983, mailed Oct. 7, 2008.

U.S. Patent and Trademark Office "Communication" for U.S. Appl. No. 12/707,320 mailed Sep. 16, 2010.

* cited by examiner

METHOD OF FORMING A LINED TUBULAR MEMBER

PRIORITY

This application claims the benefit of and is a continuation of U.S. patent application Ser. No. 10/246,777 entitled "Method and Apparatus for Forming a Modified Conduit" to L. Robert Zifferer and Edward A. Reed, filed on Sep. 18, 2002 now U.S. Pat. No. 6,923,035 B2.

BACKGROUND

1. Field of the Invention

The present invention generally relates to conduits. The present invention generally relates to a conduit having a corrugated portion with a distance from a center of the conduit to a highest portion of a ridge that is substantially the same as the radius of an un-corrugated portion of the conduit. The present invention also generally relates to an apparatus and method for forming a corrugated conduit having a corrugated portion and an un-corrugated portion.

2. Description of Related Art

The use of conduits, such as tubes and pipe, is well known. For example, elongated hollow tubes may be used as heat exchange tubes. The use of tubes in heat exchangers is disclosed in various U.S. patents, including U.S. Pat. No. 2,365,688 to Dewey; U.S. Pat. No. 2,342,117 to Brown et al.; U.S. Pat. No. 2,499,901 to Brown; U.S. Pat. No. 2,797,554 to Donovan; and U.S. Pat. No. 4,162,702 to Andersson, all of which are incorporated by reference as if fully set forth herein.

In some applications, such as tube-in-shell type heat exchangers, tubes having a non-uniform outer surface have been proposed. For example, in U.S. Pat. Nos. 5,251,693 and 5,311,661 to Zifferer, both of which are incorporated by reference as if fully set forth herein, a heat exchange tube having a portion that includes corrugations is described. U.S. Pat. No. 4,377,083 to Shepherd; U.S. Pat. No. 4,514,997 to Zifferer; U.S. Pat. No. 2,110,965 to Singer; 2,378,729 to Schmidt; and U.S. Pat. No. 4,383,429 to Ceccacci, all of which are incorporated by reference as if fully set forth herein, also describe modifications of cross-sectional shape and/or area of conduits. U.S. Pat. No. 5,016,806 to Yapp et al., which is incorporated by reference as if fully set forth herein, describes the use of rollers to impart a desired shape to a tubular member.

Conduits may be formed of many different materials. Some conduits may be made of materials that are relatively soft (e.g., copper or aluminum). Wall thickness of some conduits may be relatively thin. A conduit made of a relatively soft material and/or a conduit having a relatively thin wall thickness may be corrugated using blades to press indentions in the conduit. Some conduits may be made of relative hard materials (e.g., carbon steel, stainless steel, titanium). Some conduits may have relatively a relative large wall thickness. The use of blades to form a corrugated conduit from a relatively hard material and/or from a conduit having a relatively large wall thickness may be difficult.

A pointing device may be used to form a conduit with a reduced diameter end. U.S. Pat. No. 5,311,661 to Zifferer, which is incorporated by reference as if fully set forth herein, describes a pointing device for forming a reduced diameter end portion in a conduit.

SUMMARY

Certain embodiments described herein generally relate to a method of forming a lined tubular member. The lined tubular member may be formed by a method including inserting a corrugated conduit in a tubular member. The corrugated conduit may be expanded while the corrugated conduit is inside the tubular member. The tubular member may include ends with an inner diameter smaller than an inner diameter of a middle portion of the tubular member.

Expanding the corrugated conduit inside the tubular member may include hydraulically expanding the corrugated conduit against the walls of the tubular member. In some embodiments, expanding the corrugated conduit includes sealing the tubular member. In certain embodiments, an extended conduit is formed by coupling end portions of the corrugated conduit with an additional one or more corrugated conduits, and expanding the extended corrugated conduit within the tubular member.

In some embodiments, the tubular member is a drill stem. The drill stem may include one or more threaded ends and a middle portion. An inner diameter of at least one of the threaded ends of the drill stem may be smaller than an inner diameter of the middle portion of the drill stem.

BRIEF DESCRIPTION OF THE DRAWINGS

Advantages of the present invention will become apparent to those skilled in the art with the benefit of the following detailed description of embodiments and upon reference to the accompanying drawings in which.

Figure 1:
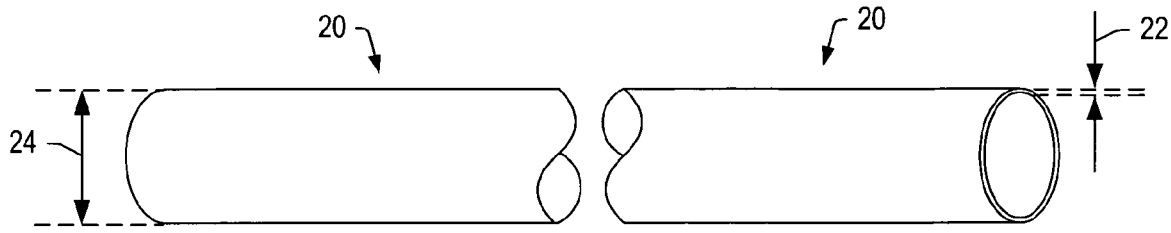
FIG. 1 shows a perspective view of an unmodified conduit.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF EMBODIMENTS

FIG. 1 depicts an embodiment of conduit 20. Conduit 20 may be made of metal, metal alloy, or polymer. In some embodiments, the conduit may be made of a relatively hard metal. For example, conduit 20 may have a hardness equal or greater than the hardness of carbon steel. In some embodiments, conduit 20 may be formed of stainless steel, carbon steel, titanium, titanium alloys, or combinations thereof. In other embodiments, conduit 20 may be made of a softer material (e.g., copper, copper alloys, aluminum, or aluminum alloys). A length of conduit 20 may be chosen so that a corrugated conduit that is formed from conduit 20 has a desired length. In some embodiments, length of conduit 20 may about 40 feet. Shorter or longer lengths may be used to produce a corrugated conduit of a desired length.

Conduit 20 may have thickness 22. Thickness 22 of conduit 20 may be any desired thickness. In some embodiments, conduit 20 may be schedule 40 or heavier gage pipe. In other embodiments, the conduit may have a relatively thin wall thickness. For example, a conduit may be a 20 gage, 7 gage, or lighter gage pipe.

Conduit 20 may have outer diameter 24. Conduit 20 may have an initial outer diameter in a range from about ½ inch to 12 inches or more. In an embodiment, a conduit has a nominal diameter of about 5 inches.

Figure 2:
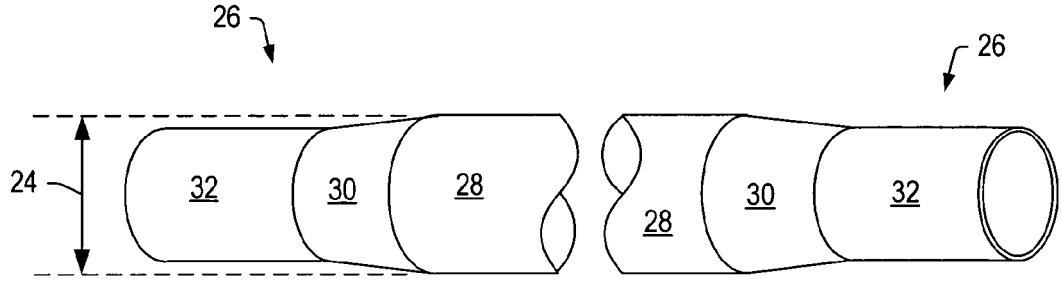
FIG. 2 depicts a conduit with reduced diameter end portions.

A pointing device may be used to transform conduit 20 into a pointed conduit. A pointed conduit refers to a conduit with at least one end that has a smaller diameter than a diameter of a body of the conduit. FIG. 2 depicts a representation of pointed conduit 26 formed from conduit 20 of FIG. 1. Pointed conduit 26 may include body 28, frustro-conical portions 30, and end portions 32. Outer diameter of body 28 may be the same as outer diameter of conduit 20. End portions 32 may have outer diameters that are smaller than the outer diameter of body 28. An outer diameter of a first end portion may be the same or different than an outer diameter of a second end portion. A length of a first end portion may be the same or different than a length of a second end portion. In some embodiments, a pointing device may be used to point only one end of a conduit. In an embodiment, outer diameter of end portions 32 may be about 3-6 inches (e.g., 4.25 inches) while outer diameter of body 28 may have a 4-8 inch (e.g., 5 inch) nominal diameter.

A conduit may be corrugated. A corrugated conduit refers to a conduit having a number of indentions in a body of the conduit that form ridges and grooves in the conduit. Indentions in the conduit may change both an outer surface and an inner surface of the conduit. In some embodiments, grooves and ridges may be formed in a symmetrical pattern about a circumference of a conduit. In some embodiments, grooves and ridges may be formed in an asymmetric pattern about a circumference of a conduit. In some embodiments, grooves and ridges may be formed in a portion of the circumference of a conduit. Grooves and ridges may have shapes including, but not limited to, arcuate, semi-circular, rectangular, trapezoidal, or v-shapes. Certain grooves/ridges may have sizes and/or shapes that are different than the sizes and/or shapes of other grooves/ridges.

Figure 3:
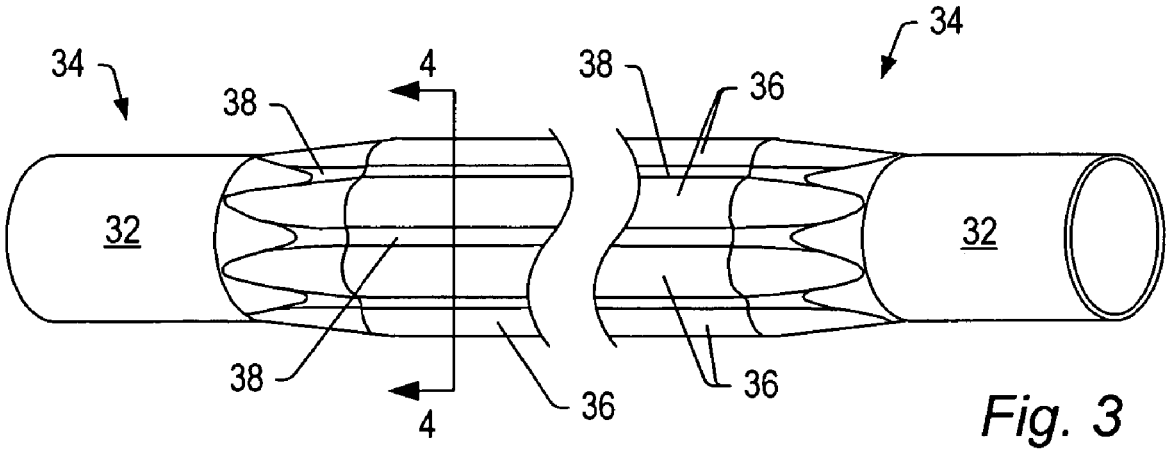
FIG. 3 depicts an embodiment of a corrugated conduit.
Figure 4:
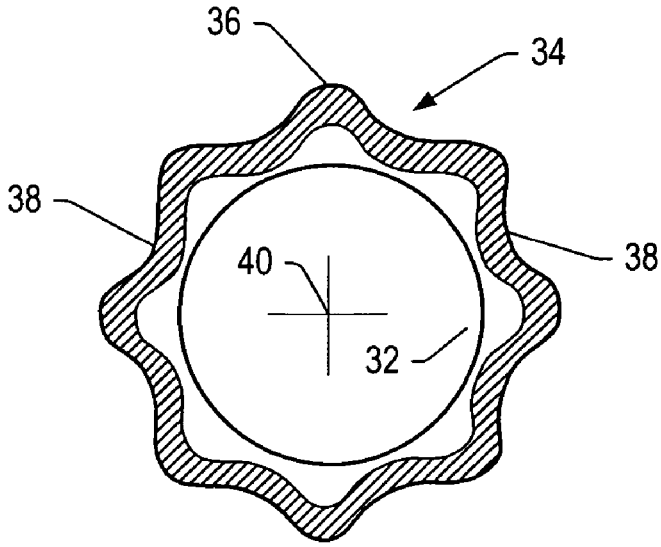
FIG. 4 depicts a cross section of a corrugated conduit embodiment taken substantially along line 4-4 of FIG. 3.

FIG. 3 depicts an embodiment of corrugated conduit 34 formed from a pointed conduit similar to the pointed conduit depicted in FIG. 2. A conduit modifier used to form corrugated conduit 34 may have a single set of rollers. A "roller" is defined as a device that turns around an axis and in doing so can bend at least a portion of another piece, such as a conduit. Corrugated conduit 34 may include un-corrugated end portions 32, ridges 36, and grooves 38. A "ridge" is defined as a raised strip on or in a piece, such as a conduit. FIG. 4 depicts a cross-sectional representation of corrugated conduit 34. A distance from center 40 of corrugated conduit 34 to an outermost surface of a ridge of ridges 36 may be substantially the same distance as the radius to the outer surface of body 28 of pointed conduit 26. In some embodiments, a distance from center 40 to a bottom of a groove of grooves 38 on an outer surface of corrugated conduit 34 may be substantially the same as the radius to the outer surface of end portion 32 of pointed conduit 26.

Ridges 36 and grooves 38 may have shapes including, but not limited to, arcuate, semi-circular, rectangular, trapezoidal, or v-shapes. In some embodiments, ridges 36 and grooves 38 may be evenly spaced around corrugated conduit 34. In other embodiments, the spacing of grooves and ridges may be asymmetrical. The number of ridges 36 formed in conduit 34 may range from about 3 to about 20 ridges. In some embodiments, the number of ridges formed in a conduit may range from about 6 to about 10. In an embodiment, 8 ridges are formed in a conduit.

Figure 5:
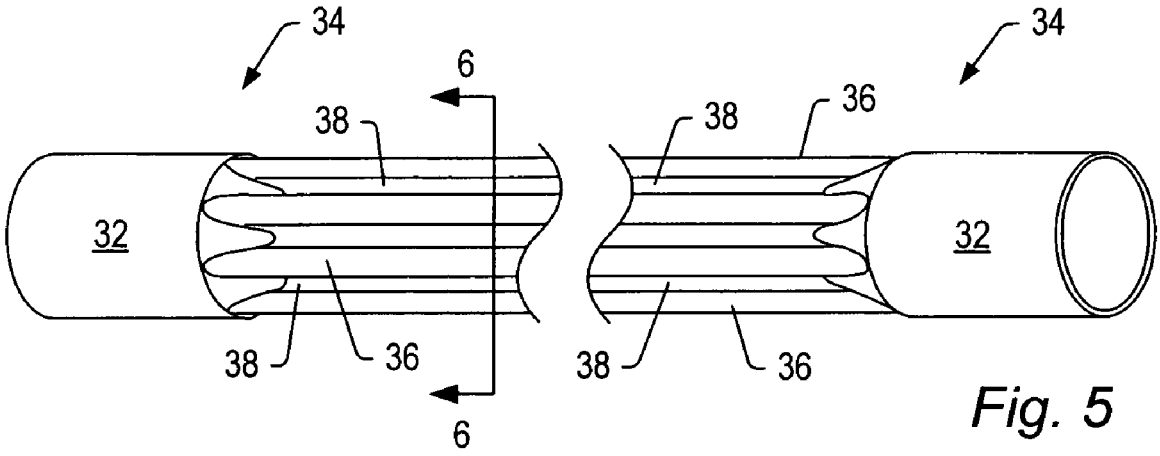
FIG. 5 depicts an embodiment of a corrugated conduit.
Figure 6:
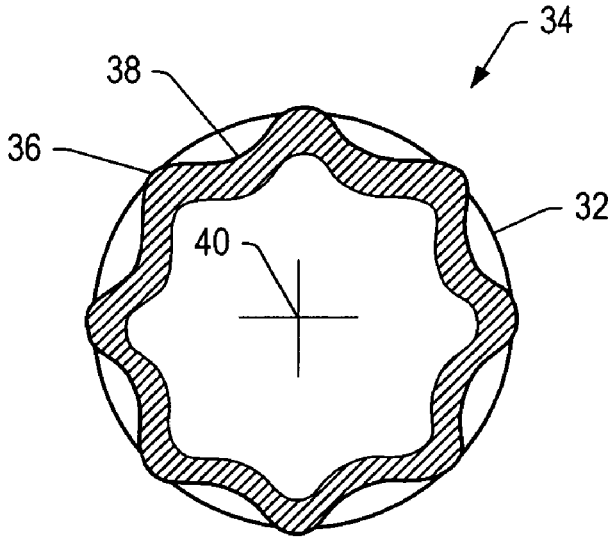
FIG. 6 depicts a cross section of a corrugated conduit embodiment taken substantially along line 6-6 of FIG. 5.

FIG. 5 depicts an embodiment of corrugated conduit 34 formed from a pointed conduit similar to the pointed conduit depicted in FIG. 2. A conduit modifier used to form corrugated conduit 34 may have two or more sets of rollers. Corrugated conduit 34 may include un-corrugated end portions 32, ridges 36, and grooves 38. FIG. 6 depicts a cross-sectional representation of corrugated conduit 34. A distance from center 40 of corrugated conduit 34 to an outermost surface of a ridge of ridges 36 may be substantially the same distance as the radius to the outer surface of end portions 32.

Corrugating a conduit may result in a strong conduit that is more resistant to bending moments than an un-corrugated conduit used to form the corrugated conduit. A corrugated conduit may have an aesthetically pleasing shape. In some embodiments, a corrugated conduit may be used as a structural member. Corrugating a conduit may increase outer and inner surface areas of a conduit. Corrugations in a conduit may promote turbulent fluid flow in and/or around the conduit. Increased surface area and the promotion of turbulent flow may increase the desirability of using the conduit as a heat exchanger element. The conduit may be, but is not limited to being, a heat exchanger element of a co-current heat exchanger, a counter-current heat exchanger, or a baffled heat exchanger.

Figure 16:
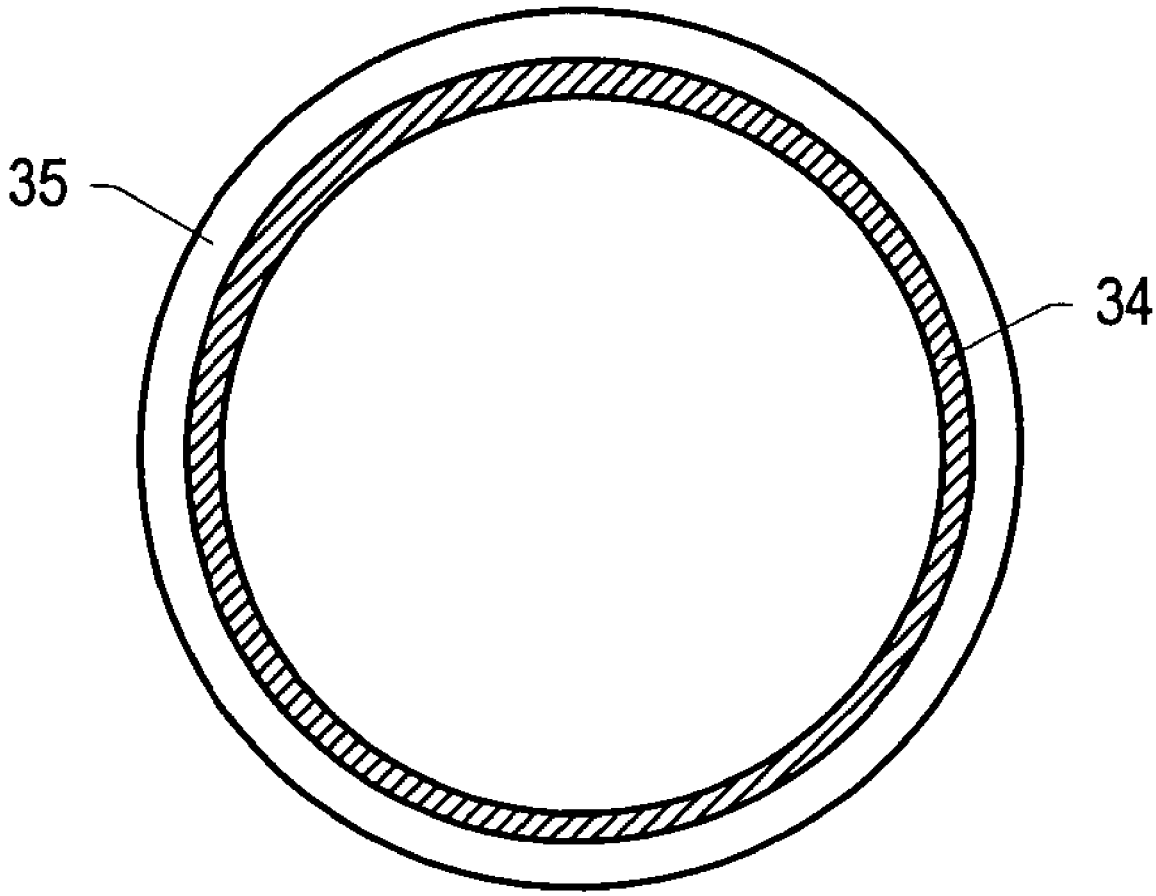
FIG. 16 depicts a cross-sectional view of an embodiment of a corrugated conduit expanded against the walls of a tubular member.

In some embodiments, a corrugated conduit may be formed to serve as an expandable conduit. The corrugated conduit may be inserted into a tubular member to strengthen and/or seal the tubular member when the corrugated conduit is expanded in the tubular member. After inserting the corrugated conduit into the tubular member, the conduit may be hydraulically or otherwise expanded against walls of the tubular member. FIG. 16 depicts a cross-sectional view of an embodiment of corrugated conduit 34 expanded against the walls of tubular member 35. In some embodiments, conduits may be used to form linings in petroleum drill stems. Drill stems may have threaded ends to accommodate interconnections for deep hole drilling. The threaded ends may have an inner diameter smaller than an inner diameter of a middle portion of the drill stem. A corrugated conduit with ridges that are located a distance from a center of the conduit that is substantially the same as a radial distance of an un-corrugated portion of the conduit may facilitate insertion of the corrugated conduit into the drill stem. After insertion, the corrugated portion of the conduit may be expanded against the drill stem. In an embodiment, a corrugated conduit of extended length may be formed by coupling end portions of two or more corrugated conduits together. The extended corrugated conduit may be expanded hydraulically within the drill stem.

Figure 7:
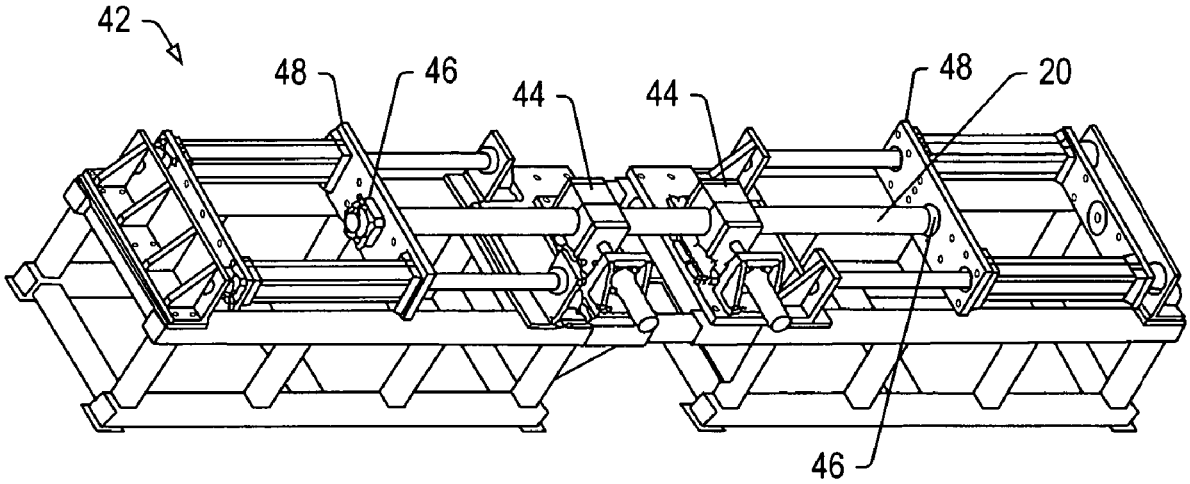
FIG. 7 depicts a perspective view of an embodiment of a pointing device used to reduce an outer diameter of at least one end portion of a conduit.

A pointing device may be used to form pointed conduit 26 (shown in FIG. 2) from conduit 20 (shown in FIG. 1). FIG. 7 depicts an embodiment of pointing device 42 that may be used to form pointed conduit 26. Pointing device 42 may include a pair of clamps 44, point reduction dies 46, and slidable die carriers 48. In an embodiment, pointing device 42 may reduce an outer diameter of an end of conduit 20. In another embodiment, pointing device 42 may simultaneously reduce outer diameters at both ends of conduit 20. In some embodiments, a pointing device may be adjustable to accommodate conduits of differing lengths and diameters.

Conduit 20 may be secured in clamps 44. After conduit 20 is secured in clamps 44, slidable die carriers 48 may be actuated to engage respective point reduction dies 46 with ends of conduit 20. A drive system used to move die carriers 48 and/or conduit 20 may be a hydraulic drive system.

Figure 8:
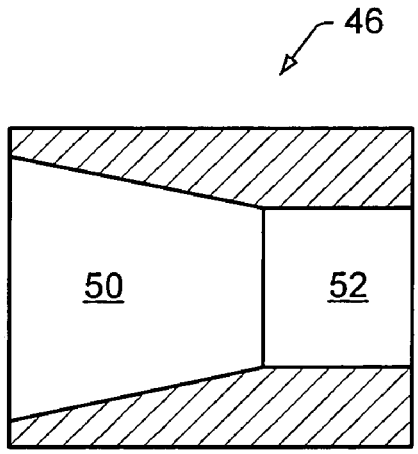
FIG. 8 depicts a cross-sectional view of an embodiment of a point reduction die.

FIG. 8 depicts an embodiment of reduction die 46 of a pointing device. Reduction die 46 may include frustro-conical section 50 and cylindrical section 52. A wide end of frustro-conical section 50 may have a diameter that allows for insertion of a conduit that is to be pointed. As the conduit is forced into reduction die 46, the diameter of the conduit may be reduced to a diameter of cylindrical section 52. After a sufficient length of small diameter section of conduit has been formed, a force used to push the conduit into reduction die 46 may be removed, and the reduction die may be separated from formed pointed conduit 26. Frustro-conical section 50 of reduction die 46 may form frustro-conical portion 30 of pointed conduit 26, as shown in FIG. 2.

Figure 9:
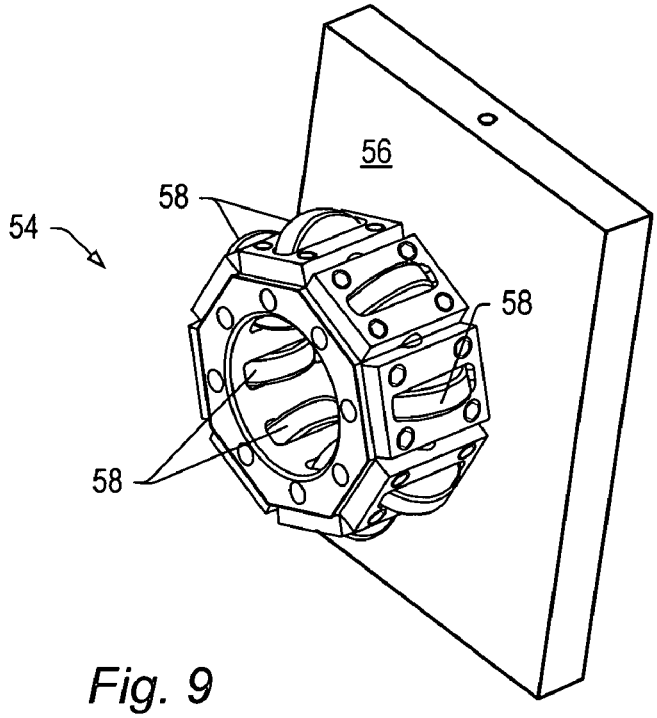
FIG. 9 depicts a perspective view of an embodiment of a conduit modifier having a single set of rollers.

FIG. 9 depicts an embodiment of conduit modifier 54 having a single set of rollers. The embodiment of conduit modifier 54 may be used to form a corrugated conduit such as corrugated conduit 34 depicted in FIG. 3. Conduit modifier may include back plate 56. Back plate 56 may be mounted upon or included as part of a device (e.g., a draw bench). Conduit modifier may include a first set of rollers 58 surrounding a central passage. Rollers 58 may be mounted in roller housings. Rollers 58 may be supported by axles and bearings mounted in the roller housings.

Rollers 58 of conduit modifier 54, such as the conduit modifier depicted in FIG. 9, may be radially spaced around the central passage so that an end portion of a pointed conduit is able to pass through the central passage without touching rollers 58. A frustro-conical portion and a body of the pointed conduit may contact rollers 58 when the pointed conduit is pushed and/or pulled through the central passage. Rollers may indent the conduit and form a series of grooves and ridges in the pointed conduit to produce a corrugated conduit.

Figure 10:
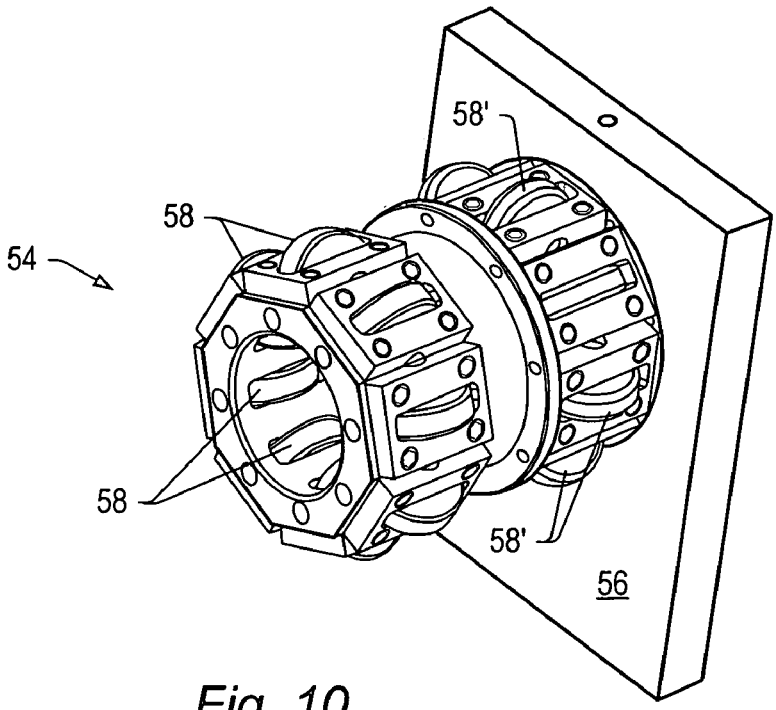
FIG. 10 depicts a perspective view of an embodiment of a conduit modifier having two sets of rollers.

FIG. 10 depicts an embodiment of conduit modifier 54 having two sets of rollers. The embodiment of conduit modifier 54 may be used to form a corrugated conduit such as corrugated conduit 34 depicted in FIG. 5. Rollers 58 and rollers 58' may surround a central passage. Rollers 58, 58' may be mounted in roller housings. Rollers 58, 58' may be supported by axles and bearings mounted in the roller housings.

Figure 11:
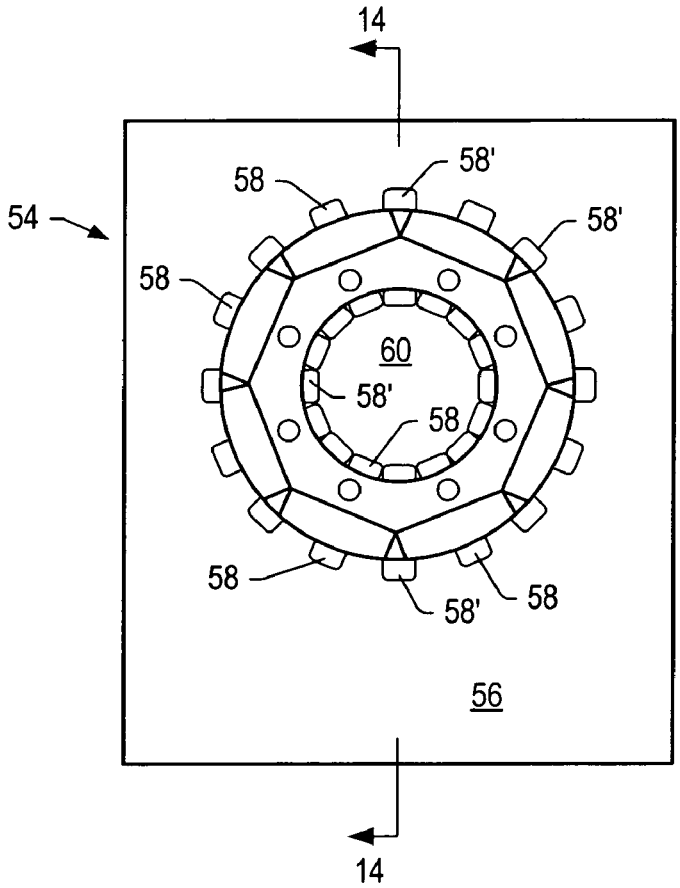
FIG. 11 depicts an end view of an embodiment of a conduit modifier having two sets of rollers.

As shown in FIG. 11, rollers 58 may alternate with rollers 58' around central passage 60. When a pointed conduit is inserted into central passage 60 of conduit modifier 54, rollers 58 may contact a frustro-conical portion and a body of the pointed conduit. Rollers 58 may indent walls of the conduit to form grooves and ridges in the conduit. Ridges formed by rollers 58 may then contact rollers 58'. Rollers 58' may push the ridges towards an axis of central passage 60 (i.e., towards the longitudinal axis of the central passage). Grooves between ridges may also move towards the axis of central passage 60.

Figure 12:
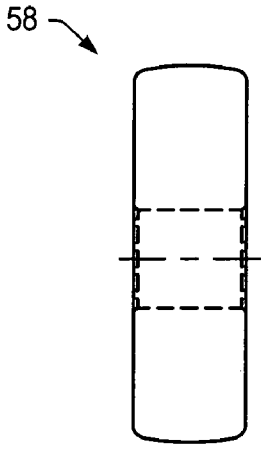
FIG. 12 depicts an embodiment of a roller for a conduit modifier.
Figure 13:
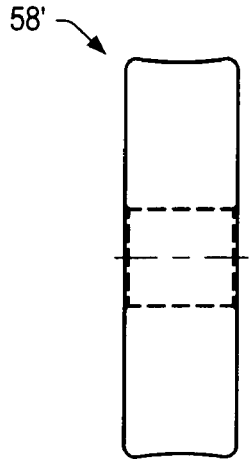
FIG. 13 depicts an embodiment of a roller for a conduit modifier.

FIG. 12 depicts an embodiment of roller 58 of conduit modifier 54 having rollers 58 and rollers 58'. An outer surface of roller 58 may have a convex shape. FIG. 13 depicts an embodiment of roller 58'. An outer surface of roller 58' may have a concave shape. The concave shape may conform better to a shape of a ridge formed by roller 58.

In an embodiment of conduit modifier used to form corrugated conduit from 5 inch nominal diameter pipe, rollers may be about 3 inches in diameter. Widths of the rollers may be chosen to form grooves and ridges of desired sizes. In an embodiment, a width of each roller is about 0.75 inches.

In some embodiments, rollers may not need to be formed of very hard materials to indent conduits. Rollers may be made of material that is harder than the conduits being corrugated. A significant portion of force between the rollers and a conduit being corrugated may be borne by bearings supporting the rollers. Supporting a significant portion of load applied to the rollers on bearings may allow the rollers to be formed of relative inexpensive material and long lasting material (i.e., as compared to tungsten carbide rollers).

In an embodiment, rollers may be designed to produce a desired surface geometry, outer diameter, and/or cross-sectional shape of a conduit. Diameter, face thickness, and shape of the rollers may be chosen to produce desired corrugations. In some embodiments, rollers may include roughened surfaces to form texturing in corrugations formed in a conduit. In some embodiments, texturing may be formed in a corrugated conduit after the conduit is formed. Texturing may be formed in a corrugated conduit by, but is not limited to being formed by, scoring, etching, and/or peening a surface or surfaces of the corrugated conduit. In some embodiments, a corrugated conduit may be chemically and/or mechanically polished to reduce the presence of texturing in surfaces of the conduit.

Figure 14:
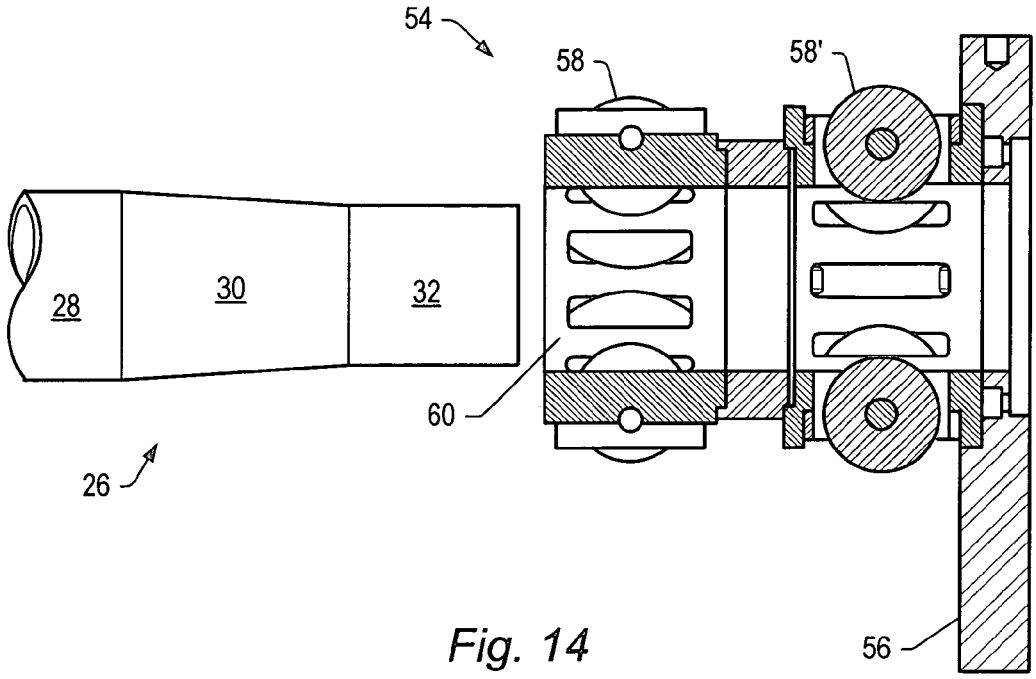
FIG. 14 depicts a cross-sectional representation of a conduit modifier taken substantially along line 14-14 of FIG. 11.

FIG. 14 depicts pointed conduit 26 prior to insertion into conduit modifier 54. Pointed conduit 26 may be formed using pointing device 42 depicted in FIG. 7. Pointed conduit 26 may be moved into central passage 60 of conduit modifier 54. In some embodiments, a portion of the conduit that has passed through conduit modifier 54 may be grasped and a remaining portion of the conduit may be pulled through the conduit modifier.

Figure 15:
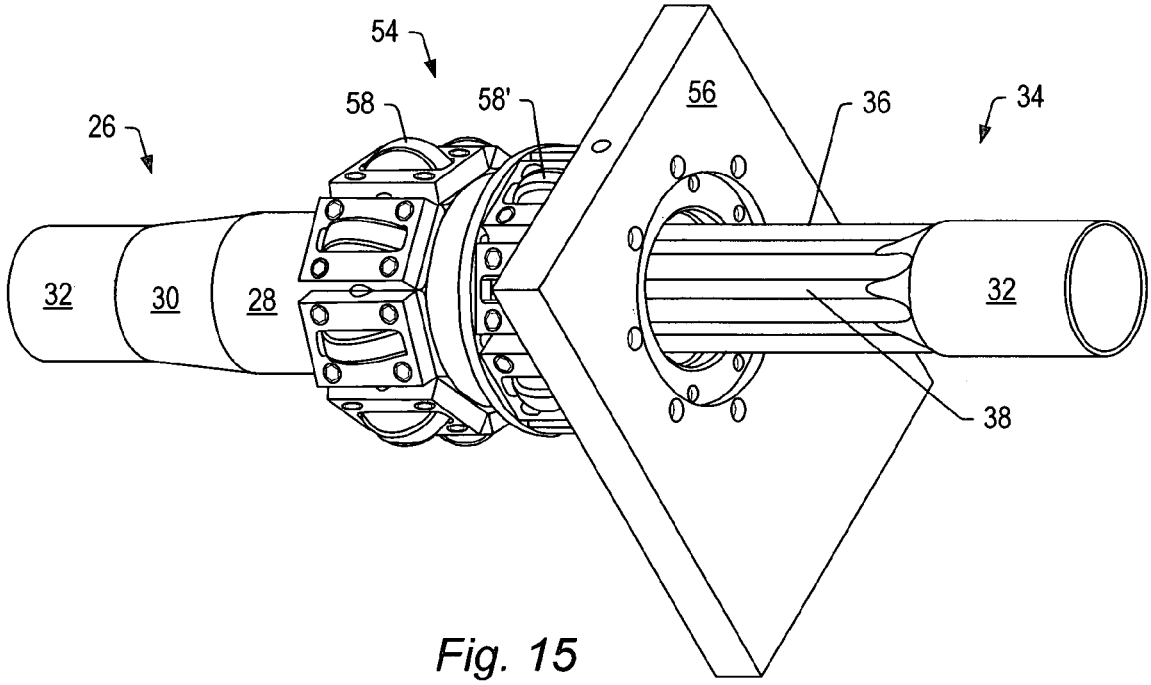
FIG. 15 depicts a perspective view of a conduit modifier during formation of a corrugated conduit.

End portions 32 of pointed conduit 26 may pass through central passage 60 without contacting rollers 58 and rollers 58'. Frustro-conical section 30 and body 28 may contact rollers 58 and rollers 58'. FIG. 15 depicts a conduit modifier during formation of a corrugated conduit. Rollers 58 and rollers 58' of conduit modifier 54 may form indentions in pointed conduit 26 to form corrugated conduit 34. Rollers 58' may push ridges 36 formed by rollers 58 inwards so that a height of the ridges in corrugated conduit 34 from a center axis of the conduit is about the same as the outer radius of un-corrugated end portion 32 of the corrugated conduit.

The apparatus and method described herein may be used advantageously for forming modified conduits quickly and efficiently, without requiring frequent replacement of machine components. Large and/or heavy-duty conduits may be modified to form corrugated conduits. In some embodiments, a distance from a central axis to an outermost portion of a ridge of a corrugation may be substantially the same as a radius from the central axis to an outer diameter of an un-corrugated portion of the conduit.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A method of forming a lined tubular member, comprising:

forming corrugations in conduit having at least one substantially tapered end to form a corrugated conduit, wherein the conduit is formed of metal, and wherein the corrugated conduit comprises ridges that are located a distance from a center of the corrugated conduit that is substantially the same as a radial distance of an un-corrugated portion of the conduit;

inserting the metal corrugated conduit in a tubular member; and hydraulically expanding the corrugated conduit while the corrugated conduit is inside the tubular member.

2. The method of claim 1, wherein the ridges are at least partially compressed.

3. The method of claim 1, wherein hydraulically expanding the corrugated conduit comprises expanding the corrugated conduit against the walls of the tubular member.

4. The method of claim 1, further comprising forming an extended corrugated conduit by coupling end portions of the corrugated conduit and an additional one or more corrugated conduits together, and expanding the extended corrugated conduit within the tubular member.

5. The method of claim 1, wherein expanding the corrugated conduit comprises sealing the tubular member.

6. A method of forming a lined drill stem, comprising:

forming corrugations in conduit having at least one substantially tapered end to form a corrugated conduit, wherein the conduit is formed of metal and wherein the corrugated conduit comprises ridges that are located a distance from a center of the corrugated conduit that is substantially the same as a radial distance of an un-corrugated portion of the conduit;

inserting the metal corrugated conduit in a drill stem comprising one or more threaded ends and a middle portion, wherein an inner diameter of at least one of the threaded ends of the drill stem is smaller than an inner diameter of the middle portion of the drill stem; and hydraulically expanding the metal corrugated conduit while the metal corrugated conduit is inside the drill stem.

7. The method of claim 6, wherein the corrugated conduit comprises ridges and grooves, and wherein the ridges are at least partially compressed.

8. The method of claim 6, wherein the corrugated conduit comprises one or more un-corrugated portions, wherein the corrugated portion comprises grooves, and wherein a distance from the center of the corrugated conduit to an outermost surface of one of the ridges is substantially the same distance as a radius of at least one of the un-corrugated portions of the corrugated conduit.

9. The method of claim 6, wherein hydraulically expanding the corrugated conduit expands the corrugated conduit against the walls of the drill stem.

10. The method of claim 6, further comprising forming an extended corrugated conduit by coupling end portions of the corrugated conduit and an additional one or more corrugated conduits together, and expanding the extended corrugated conduit within the drill stem.

11. The method of claim 6, wherein expanding the corrugated conduit comprises sealing the drill stem.

12. A method of forming a lined tubular member, comprising:

forming corrugations in conduit having at least one substantially tapered end to form a corrugated conduit, wherein the conduit is formed of metal;

providing the metal corrugated conduit inside a tubular member, wherein the tubular member comprises ends with an inner diameter smaller than an inner diameter of a middle portion of the tubular member; and hydraulically expanding the corrugated conduit to seal the tubular member.

13. The method of claim 12, wherein the corrugated conduit comprises ridges and grooves, and wherein the ridges are at least partially compressed.

14. The method of claim 12, wherein the corrugated conduit comprises one or more un-corrugated portions and a corrugated portion, wherein the corrugated portion comprises grooves and ridges, and wherein a distance from the center of the corrugated conduit to an outermost surface of one of the ridges is substantially the same distance as a radius of at least one of the un-corrugated portions of the corrugated conduit.

15. The method of claim 12, wherein the corrugated conduit comprises ridges that are located a distance from a center of the corrugated conduit that is substantially the same as a radial distance of an un-corrugated portion of the conduit.

16. The method of claim 12, wherein providing the corrugated conduit inside the tubular member comprises inserting the corrugated conduit into the tubular member.

* * * * *